United States Patent [19]

Ovshinsky et al.

[11] Patent Number: 4,715,891

[45] Date of Patent: Dec. 29, 1987

[54] METHOD OF PREPARING A MAGNETIC MATERIAL

[75] Inventors: Stanford R. Ovshinsky, Bloomfield Hills; Stephen J. Hudgens, Southfield; David D. Allred, Troy; Gregory DeMaggio, Bloomfield Hills, all of Mich.

[73] Assignee: Ovonic Synthetic Materials Company, Inc., Troy, Mich.

[21] Appl. No.: 919,935

[22] Filed: Oct. 17, 1986

[51] Int. Cl.[4] ..... H01F 1/02

[52] U.S. Cl. ..... 75/0.5 BA; 148/103; 148/105

[58] Field of Search ..... 75/0.5 BA; 148/103, 148/105

[56] References Cited

U.S. PATENT DOCUMENTS

| | | | |
|---|---|---|---|
| 2,853,402 | 9/1958 | Blois | 148/103 |
| 3,741,823 | 6/1973 | Lommel | 148/103 |
| 3,856,579 | 12/1974 | Allen | 148/103 |
| 3,856,580 | 12/1974 | Smeggil | 148/103 |
| 4,113,521 | 9/1978 | Bush | 75/0.5 R |

*Primary Examiner*—Peter D. Rosenberg
*Attorney, Agent, or Firm*—Richard M. Goldman; Marvin S. Siskind

[57] ABSTRACT

A method of forming a magnetic material. The magnetic material is a solid mass of grains, and has magnetic parameters characterized by : (1) a maximum magnetic energy product, $(BH)_{max}$, greater than 15 megagaussoersteds; and (2) a remanence greater than 9 kilogauss. The magnetic material is prepared by a two step solidification, heat treatment process. The solidification process is carried out by controlled vaporization of precursor elements of the alloy into an inert atmosphere, with subsequent controlled vapor phase condensation. This may be accomplished by vaporizing a precursor type alloy in a plasma torch, such as an argon torch, a hydrogen torch, or other electro-arc torch to form a particulate fine grain alloy. The resulting product of this alternative method is a particulate fine grain alloy. The solid particles have a morphology characterized as being one or more of (i) amorphous; (ii) microcrystalline; or (iii) polycrystalline. The grains within the solid have, at this stage of the process, an average grain characteristic dimension less than that of the heat treated magnetic material. In the second, or heat treating, stage of the process, the fine grain solid particles are heat treated to form a solid material comprised of grains meeting at grain boundaries. The grains and grain boundaries have the morphology of the magnetic material.

13 Claims, 1 Drawing Figure

METHOD OF PREPARING A MAGNETIC MATERIAL

FIELD OF THE INVENTION

The invention relates to permanent magnetic alloy materials and methods of preparing them.

BACKGROUND OF THE INVENTION

There has long been a need for a relatively inexpensive, strong, high performance, permanent magnet. Such high performance permanent magnets would be characterized by relatively high magnetic parameters, e.g. coercive force ($H_c$) or coercivity, remanent magnetization or remanence, and maximum energy product.

Moreover, an ideal high-performance permanent magnet should exhibit a square magnetic hysteresis loop. That is, upon application of an applied magnetic field H greater than the coercive force Hc, all of the microscopic magnetic moments should align parallel to the direction of the applied force to achieve the saturation magnetization Ms. Moreover, this alignment must be retained not only for H=0 (the remanent magnetization Mr), but also for a reverse applied magnetic force of magnitude less than Hc. This would correspond to a maximum magnetic energy product (the maximum negative value of BH) of $$(Mr^2/4)=(Ms^2/4)$$

Unfortunately, this ideal situation is at best metastable with respect to the formation of magnetic domains in other directions, which act to reduce Mr and $BH_{max}$.

Conventional high-performance permanent magnets that approach square-loop behavior have four general requirements:

1. The material must be composed primarily of a ferromagnetic element or compound with a Curie temperature Tc that significantly exceeds the application temperature Ta, and with Ms at Ta large. Practically speaking, this requires either Fe or Co as the major constituent.

2. In order to obtain a high coercive force, the material must consist of an assembly of small particles or crystallites.

3. These particles or crystallites must exhibit microscopic magnetic anisotropy, i.e. they must have a preferred "easy axis" of magnetization. This can follow either from shape anisotropy or magneto-crystalline interaction.

4. These microscopically anisotropic particles must be aligned substantially in parallel within the macroscopic assembly, in order to achieve values of Mr that approach Ms, i.e. square-loop behavior.

The prior art teaches that good permanent magnetic materials, e.g., having maximum magnetic energy products of about 15 megagaussoersteds, consist of a conglomeration of non-interacting substantially crystallographically oriented uniaxial particles. When a sufficiently large magnetic field is applied in a given direction, the individual vector magnetizations of each of these particles point along the applied field, corresponding to the maximum or saturation value of the net magnetization, $M_s$. As the applied magnetic field is reduced to zero, the vector magnetization of each particle relaxes back to the easy magnetic axis of the particle, so that the net resultant remanent magnetization, $M_r$, may be less than $M_s$.

This is more fully elucidated by the following geometrical model, in which the "easy axis" of magnetization lies along a preferred axis, c. For an isolated uniformly magnetized particle, the magnetization vector, M, lies along the c axis for a zero applied field. If a field is applied in an arbitrary direct1on z, the magnetization is rotated away from the c axis until, at sufficiently large fields, M is parallel to z and $M_z$ is equal to $M_s$. When the field is removed, the magnetization relaxes back parallel to the c axis, subject to the condition that the projection of magnetization along the c axis is positive.

E. C. Stoner and E. V. Wohlfarth, Phil. Trans. Royal Soc. (London), A. 240, 599 (1948) have calculated the hysteresis loop for such a particle for different orientations of the c axis with respect to z. For the case of a sample comprising a large number of such non-interacting particles oriented along some direction, the magnetic properties for the material or sample are the sum or average of the properties of the individual particles. Such a sample or material is hereinafter referred to as an anisotropic material. Anisotropic materials have at least one magnetic property which is a strong function of the direction of measurement. Such materials are characterized by a single "easy direction" of magnetization, where the value of the property greatly exceeds the value in other directions of magnetization. If the particles are non-interacting, the maximum energy product varies from a maximum value of 0.25 $(M_s)^2$, when z is parallel to the c axis, to 0 when z is perpendicular to the c axis. For a theoretical anisotropic material with $M_s$ equal to 16 and $H_c$ chosen to be greater than $M_s$, the maximum theoretical value of the energy product of the hysteresis loop is 64 megagaussoersteds.

Stoner and Wohlfarth have carried out the same method of analysis for an ideal array of randomly oriented non-interacting uniformly magnetized particles. Since the array is isotropic there is no dependence of the hysteresis loop on the direction of the applied field. The maximum theoretical value of the energy product of such a loop is dependent on $M_s$ and $H_c$. If $M_s$ is chosen to equal 16 kilogauss and $H_c$ is chosen to be much greater than $M_s$, then the maximum energy product is 16 megagaussoersteds.

Hence, the teaching of the prior art for a perfectly oriented non-interacting material (anisotropic) is that the maximum energy product is at least four (4) times that of the same material when randomly oriented (isotropic).

For a general distribution of orientations of non-interacting particles, as a consequence of simple vector geometry, $$(M_r/M_s)=[\cos(theta)],$$

where theta is the angle between the applied field and the easy axis of a given particle, and the result, indicated by double brackets, represents the size weighted average over all of the particles. As is well understood in the art, $M_r/M_s=1$ along the direction of orientation of a perfectly oriented, non-interacting, permanent magnet sample (anisotropic), and $M_r/M_s=0.5$ in all directions for a completely unoriented, non-interacting sample (isotropic). See, e.g., R. A. McCurrie, "Determination of the Easy Axis Alignment in Uniaxial Permanent Magnets for Remanence Measurements", J. Appl. Phys., Vol. 52, (No. 12), pages 7344–7346 (December 1981). Observations in the literature are consistent with this prediction. See, e.g., J. F. Herbst and J. C. Tracy, "On Estimating Remanent Magnetization from X-Ray Pole Figure Date", J. Appl. Phys., Vol. 50 (No. 6), pp. 4283–4284 (June 1979).

A figure of merit, which applicants refer to as the magnetic retention parameter, is $$Q=Sum_{x,y,z}(M_r/M_s)^2,$$

where $M_s$ and $M_r$ are measured with the applied magnetic field along three orthogonal directions. Theoretically, for magnetic materials of the prior art, Q approaches 1 for perfectly oriented, non-interacting, particles or crystallites (anisotropic) and 0.75 for completely unoriented, non-interacting, crystallites (isotropic). The behavior for reported values of permanent magnetic materials of the prior art tend to produce values of Q which are substantially below the theoretical values. See, e.g., McCurrie; Herbst and Tracy; and Stoner and Wohlfarth; above.

Prior art systems which are non-interacting and conform to the assumptions of and models in Stoner and Wohlfarth are described in the Background sections of commonly assigned copending U.S. application Ser. No. 816,778, filed Jan. 10, 1986, of R. Bergeron, R. McCallum, K. Canavan, and J. Keem for *Enhanced Remanence Premanent Magnetic Alloy Bodies and Methods of Preparing Same,* and U.S. application Ser. No. 893,516, filed Aug. 5, 1986 of R. Bergeron, R. McCallum, K. Canavan, J. Keem, A. Kadin, and G. Clemente, for *Enhanced Remanence Permanent Magnetic Alloy and Bodies Thereof.* The Prior art materials described and discussed in the Background sections of our earlier applications do not exhibit any deviations from the assumptions and models of Stoner and Wohlfarth.

Deviations from (Mr/Ms)=[Cos (theta)] corresponding to larger values of Mr might be expected to occur if the particles were permitted to interact with one another. Suggestions of this sort have appeared in the magnetic recording literature, where the proposed interaction was due to long range magnetic dipole fields. See, for example, H. N. Bertram and A. K. Bhatia, *The Effect of Interaction on the Saturation Remanence of Particulate Assemblies,* IEEE Trans. on Magnetics, MAG-9, pp 127–133 (1983), and R. F. Soohoo, *Influence of Particle Interaction on Coercivity and Squareness of Thin Film Recording Media,* J. Appl. Phys., Vol 52(3), pp 2459–2461 (1981). However, this assumption of interactions has been questioned. See, for example, P. M. Davis, *Effects of Interaction Fields on the Hysteretic Properties of Assemblies of Randomly Oriented Magnetic or Electric Moments,* J. Appl. Phys., Vol 51 (2), pp 594–600 (1980).

Suggestions of short range interactions based on exchange have also been made with respect to amorphous iron-rare earth alloys at cryogenic temperatures by E. Callen, Y. L. Liu, and J. R. Cullen, *Initial Magnetization, Remanence, and Coercivity of the Random Anisotropy Amorphous Ferromagnet* Phys. Rev. B, Vol. 16, pp 263–270 (1977).

The literature does not contain any verified indications of enhanced values of Mr relative to those predicted by Stoner and Wohlfarth, above, in isotropic permanent magnetic materials.

However, contrary to the limited but negative teachings of the prior art interaction between crystallites has been used to achieve enhanced magnetic properties in bulk solid materials. Magnetic materials which utilize interactions are described in commonly assigned copending U.S. application Ser. No. 816,778, filed Jan. 10, 1986, of R. Bergeron, R. McCallum, K. Canavan, and J. Keem for *Enhanced Remanence Premanent Magnetic Alloy Bodies and Methods of Preparing Same,* and U.S. application Ser. No. 893,516, filed Aug. 5, 1986 of R. Bergeron, R. McCallum, K. Canavan, J. Keem, A. Kadin, and G. Clemente, for *Enhanced Remanence Permanent Magnetic Alloy and Bodies Thereof,* both of which are incorporated herein by reference.

Described therein is a class of permanent magnetic alloys which exhibit superior magnetic properties as measured in all spatial directions, that is, isotropically. The magnetic parameters are of a magnitude which the prior art teaches to be only attainable in one spatial direction, that is, anisotropically, and to be only attainable with aligned materials.

The magnetic materials described in the incorporated patent applications have a ratio of net remanent magnetization ($M_r$) to net saturation magnetization ($M_s$), exceeding 0.5 and approaching 1.0, in all directions, without any significant preferred crystallite orientation. This is a clear violation of the consequences of the Stoner and Wohlfarth's model and the assumptions of the prior art that the grains must be microscopically anisotropic grains that are aligned substantially in parallel within the macroscopic body in order to achieve values of Mr approaching Ms, i.e., square hysteresis loop behavior.

These permanent magnetic materials have isotropic magnetic retention parameters, Q, as described above, greater than 0.75 and even greater than 1. The theoretical limit of the magnetic retention parameter, Q, for the herein contemplated materials is believed to approach 3, rather than the theoretical values of 1.0 and 0.75 respectively, for aligned (anisotropic) and unaligned (isotropic), non-interacting materials of the prior art.

Ribbon samples of the as quenched materials described above, without further processing, exhibit remanent magnetization, $M_r$, greater than 8 kilogauss, coercive force, $H_c$, greater than 8 kilooersteds, and preferably greater than 11 kilooersteds, and maximum energy product (BH)max greater than 15 megagaussoersteds with similar values measured in all directions, i.e., in the plane of the ribbon and perpendicular to the plane of the ribbon. In the latter case the value was obtained after a standard correction (a geometric demagnetization factor as described, for example, in R. M. Bozorth, *Ferromagnetism,* D. VanNostrand Co., New York, (1951), at pages 845–847) for the shape anisotropy of the ribbon.

The saturation magnetization $M_s$ of the ribbon, i.e., the magnetization in the limit for large applied fields, e.g., an applied magnetic field above about 50 kilogauss, is 15 to 16 kilogauss, also in all directions. In order to directly measure saturation magnetization, $M_s$, the applied field should be at least three times the coercive force, $H_c$. Alternatively, the value of $M_s$ can be estimated based on the values thereof for compositionally similar materials. The values correspond to a value of $M_r/M_s$ greater than 0.5, and a magnetic retention parameter, Q, greater than 0.75, in contradistinction to the clear teachings of the prior art for a macroscopically isotropic, non-interacting material.

Typical magnetic parameters for the magnetic alloys described in the above incorporated patent application are as shown in Table I of U.S. application Ser. No. 893,516, filed Aug. 5, 1986, Table V of U.S patent application Ser. No. 816,778. (An $M_s$ of 16 kilogauss was used.)

As can be seen from Table I of U.S. application Ser. No. 893,516, the samples of the materials described therein exhibit superior relevant magnetic parameters throughout the volume of the bulk solid, evidencing interaction between grains. The properties are especially superior when compared with the properties of the isotropic materials of the prior art listed in Table III of U.S. application Ser. No. 816,778. When compared with the anisotropic prior art materials listed in Table IV of U.S. application Ser. No. 816,778, the samples of the inventions described in the aforementioned U.S. patent application Ser. Nos. 816,778 and 893,516 (filed Aug. 5, 1986) exhibit comparable but isotropic magnetic properties, and were prepared without the costly, complicated alignment steps necessary in the prior art.

The magnetic alloy materials of U.S. application Ser. Nos. 816,778 and 893,516 have been prepared by the melt spinning process, and more particularly by the free jet casting process.

In the free jet casting process a jet of molten metal is expelled under a head of inert gas from a crucible onto a rapidly rotating chill wheel. This jet of molten metal forms a puddle of molten metal on a rapidly rotating chill wheel. The top of the puddle appears to stand stationary beneath the orifice of the crucible, while the bottom of the puddle appears to be continuously drawn away from the crucible orifice. We have observed an instability associated with the interaction between the chill wheel and the puddle. This instability is associated with a high degree of variance of magnetic properties of the cast products and a concommitant low yield of enhanced remanence magnetic alloy material.

SUMMARY OF THE INVENTION

These instabilities of the free jet casting process and the associated low yields of enhanced remanence magnetic material are obviated by the method of this invention.

The magnetic material is prepared by a two step solidification, heat treatment process. The solidification process yields a very low coercivity material, characterized as being one or more of amorphous, microcrystalline, or polycrystalline. The grains within the solid have, at this stage of the process, an average grain characteristic dimension less than that of the heat treated magnetic material, and too small to provide a practical coercivity or an enhanced remanence.

The solidification process is carried out by controlled vaporization of precursor elements of the alloy into an inert atmosphere, with subsequent controlled vapor phase condensation. According to one exemplification the controlled vaporization is carried out by vaporizing magnet alloy material precursor, as a $Nd_2Fe_{14}B_1$ type alloy, in a plasma torch, such as an argon torch, a hydrogen torch, or other electro-arc torch. The resulting product is a particulate fine grain alloy. According to an alternative exemplification a wire of magnet alloy material precursor, as a $Nd_2Fe_{14}B_1$, is vaporized, the vapor condensed, and the condensate collected.

The fine grain particulate alloy material may be recovered by various methods, including electrostatic precipitation, particle extraction, settling, sedimentation, or the like.

In the second, or heat treating, stage of the process, the solid particles, e.g., fine grain, low coercivity particles, are heat treated to form a solid material having a morphology that provides a practical coercivity and the above described enhancement of remanence. The heat treated solid is comprised of grains meeting at grain boundaries. The grains and grain boundaries have the morphology of the enhanced remanence magnetic material.

THE FIGURES

The invention may be understood by reference to the FIG. 1. FIG. 1 shows a plasma spray method of producing a fine grain, low coercivity alloy material.

DETAILED DESCRIPTION OF THE INVENTION

Figure 1:
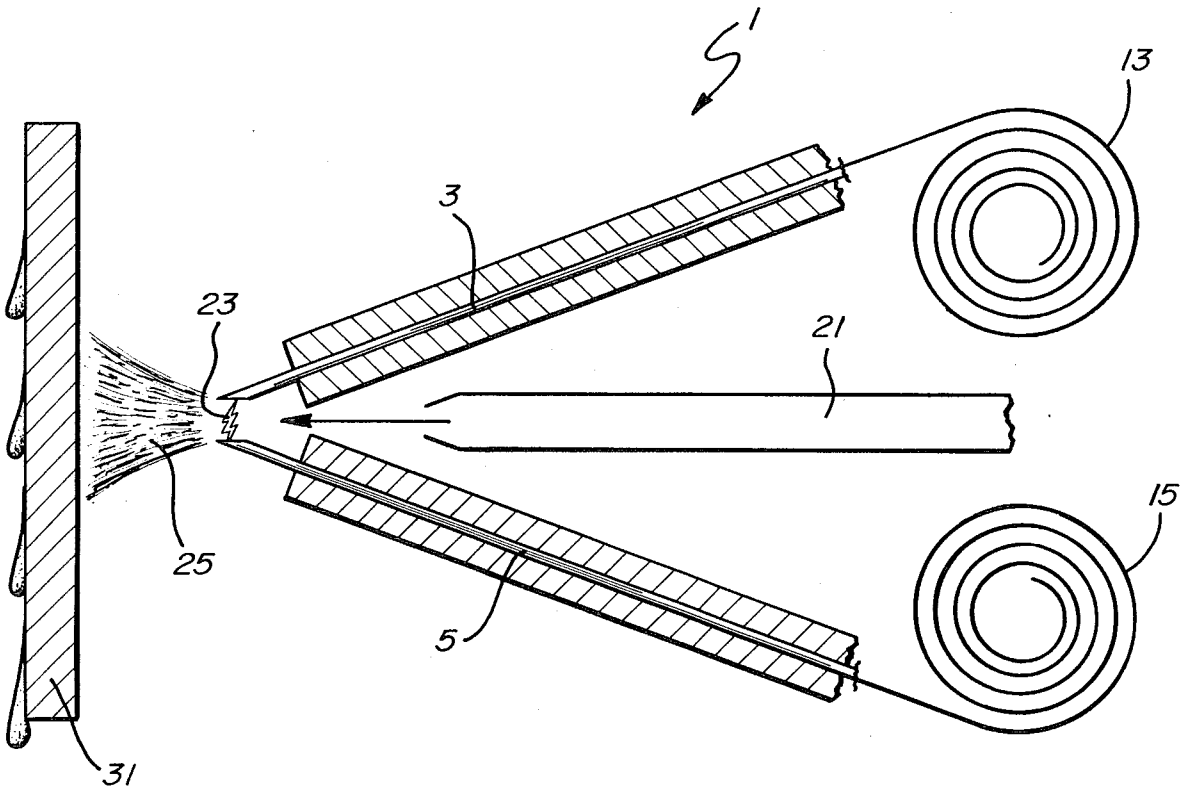

According to the invention there is provided a method of forming a class of magnetic alloy materials having superior magnetic properties. These magnetic alloy materials are high remanence materials that do not obey the Stoner and Wohlfarth assumptions of non-interacting particles. To the contrary, the individual grains or crystallites interact across grain boundaries. The enhanced magnetic properties give clear evidence of interaction across grain boundaries of individual grains or crystallites.

The alloy prepared by the method described herein are substantially crystallographically unoriented, substantially magnetically isotropic alloys, with interaction between adjacent crystallites. By substantially isotropic is meant a material having properties that are similar in all directions. Quantitatively, substantially isotropic materials include those materials where the remanence along all three orthogonal axis, after application of the appropriate geometric demagnetization factor, are interactively enhanced, i.e., greater than 8 kilogauss, as well as those materials where the average value of [Cos (theta)], defined above, is less than about 0.75 in all directions, where Cos (theta) is averaged over all the crystallites. Microscopically this means that the direction of the easy axis of magnetization is substantially random and substantially uncorrelated from grain to grain.

The materials are isotropic permanent (hard) magnets, with enhanced isotropic magnetic parameters, i.e., isotropic maximum magnetic energy products greater than 15 megagaussoersteds, magnetic retention parameters, Q, greater than 0.75, standard temperature coercivities greater than about 8 kilooersteds, and remanences greater than about 8 kilogauss, and preferably greater than above about 11 kilogauss.

The saturation magnetization $M_s$ of the ribbon, i.e., the magnetization in the limit of large applied fields, is 15 to 16 kilogauss, also in all directions. These values correspond to a value of $M_r/M_s$ greater than 0.5, and a magnetic retention parameter, Q, greater than 0.75, in contradistinction to the clear teachings of the prior art for a macroscopically isotropic material.

The magnetic material is composed of an assembly of small crystalline ferromagnetic grains.

The grains are in intimate structural and metallic contact along their surfaces, i.e., along their grain boundaries. That is, one grain of the material is in direct contact with an adjacent grain of the material at a grain boundary that is substantially free of intergranular materials and/or phases. This is contradistinction to the clear teachings of Raja K. Mishra, "Microstructure of Melt-Spun Nd-Fe-B Magnequench Magnets," Journal of Magnetism and Magnetic Materials, Vol 54–57 (1986), pages 450–456 who teaches the necessity of a 10–20 Angstrom thick film of Nd-rich, B-lean phase, $Nd_2Fe_{14}B_1$ grains. Mishra reports that this film is necessary as a pinning site for magnetic domain walls. By way of contrast, according to the instant invention grains of magnetic material are in direct contact with adjacent grains of magnetic material, e.g., grains of $Nd_2Fe_{14}B$ are in direct contact with adjacent grains of $Nd_2Fe_{14}B$.

The degree of magnetic enhancement is determined by the average characteristic dimension of the grains, Ro, the size distribution of the individual grain dimensions relative to this characteristic scale, and a characteristic dimension of the grain boundaries. The characteristic dimension of the grain boundaries must be small enough to allow interaction between adjacent grains across the grain boundaries.

The magnetic alloys are solidified or quenched to produce a precursor microstructure, which, when appropriately heat treated, results in a structure having these dimensions and morphologies and therefore exhibiting the above described improved magnetic parameters. These initially solidified particles much larger then the characteristic grain dimension $R_o$. A particle may contain at least $10^8$ grains of characteristic grain size $R_o$.

The as heat treated dimensions and morphologies are critical in obtaining the enhanced remanence and magnetic retention parameters herein contemplated.

While the above illustrations of the interaction across grain boundaries in Ser. No. 893,516 have been quantitatively described with respect to rare earth-transition metal-boron materials of tetragonal, $P4_2/mnm$ crystallography, especially the $Nd_2Fe_{14}B_1$ type materials, this is a general phenomenon applicable to other systems as well. The optimum characteristic grain dimension $R_o$, however, may be different in these other cases.

We expect that for $Pr_{2-x}Nd_xFe_{14}B_1$, $R_o$ will be approximately 200 Angstroms for all values of x. For $SmCo_5$, for example, where Curie temperature, Tc=900K, saturation magnetization, Ms=12 kG, and Hanisotropy=300 kOe, H(spin,spin)=9 MOe, so that $R_o$=(9 MOe)/(300 kOe)×2.5 Angstroms= (approximately) 80 Angstroms. Similarly, for $Sm_2Co_{17}$ $R_o$=(12 MOe)/(80 kOe)2.5 Angstroms=(approximately) 400 Angstroms.

For randomly-oriented crystallites at the optimum size, the expected magnetic enhancement attributable to quantum mechanical magnetic coupling is comparable to that estimated above for $Nd_2Fe_{14}B$ type material—an increase in $BH_{max}$ by a factor of 2 to 3 above that predicted by the Stoner and Wohlfarth model, above.

The magnetic material is prepared by a two step solidification, heat-treatment process. The solidification process yields a very low coercivity material, characterized as being one or more of amorphous, microcrystalline, or polycrystalline. The crystallites within the solid have, at this stage of the process, an average grain characteristic dimension less than that of the heat treated magnetic material, and too small to provide a practical coercivity.

The magnetic material is prepared by a two step solidification, heat treatment process. The solidification process yields a very low coercivity material, characterized as being one or more of amorphous, microcrystalline, or polycrystalline. The grains within the solid have, at this stage of the process, an average grain characteristic dimension less than that of the heat treated magnetic material, and too small to provide a practical coercivity.

The solidification process is carried out by controlled vaporization of precursor elements of the alloy into an inert atmosphere, with subsequent controlled vapor phase condensation.

The controlled vaporization of the precursor of the alloy material may be a thermal vaporization. Thus, according to one exemplification the controlled vaporization is carried out by vaporizing an alloy or alloys of the elements of magnetic alloy, e.g., a $Nd_2Fe_{14}B_1$ type alloy, in a plasma, as a plasma torch, such as an argon torch, a hydrogen torch, or other electro-arc torch.

For example, wires of ferroboron and an iron-rare earth alloy may be fed to and through an electric flame spay gun, and an arc or plasma established therebetween. The liquid particles formed form the wires at the arc are then driven by an inert or reducing gas onto a quench surface and recorved as a fine grain material, e.g., an amorphous material.

One method of carrying out the method of the invention is electroarc melting, illustrated in FIG. 1.

As herein contemplated, an arc 23 is struck between a pair of advancing metal wires 3, 5. The arc 23 melts the wires 3, 5, thereby forming molten metal particles 25. The molten metal particles 25 are carried to the electrode substrate 31 by a jet 21 of compressed air, and solidify to form a metallic film, coating, layer, or surface on the electrode substrate 31.

The wires 3, 5 are carried forward and continuously fed to the arc 23. Typically, the wires 3,5 are carried forward at a speed of from about 2 to about 10 inches per second by motor driven rollers. In this way melting rate of about 0.2 to about 3.0 pounds per minute is provided, although higher or lower rates may be utilized. The spray can be moved laterally at a pitch between of from about 0.125 inch to about 1 inch whereby to avoid the development of hot spots on the quench surface.

The wires are generally from about 0.035 inch to about 0.16 inch in diameter, i.e., from about 16 gauge B and S to about 5 gauge B and S. The wires may be clad, e.g., with the Nd and/or Pr metal as the inside, surrounded by a cladding of iron.

The electric power is sufficient to melt both wires. It is generally from about 3 kilowatts to about 24 kilowatts, i.e., from about 20 volts and 150 Amperes to about 40 volts and 100 amperes. In this way an arc temperature is provided that is hot enough to melt both wires, and to maintain the metals, including alloys and intermetallic compositions thereof molten under cnditions such as to form alloys, intermetallic compounds, and intimate mixtures thereof.

When a quench surface is used, the arc is generally spaced from about 0.125 inch to about 1.00 inch from the quench surface. The tips may be perpendicular to the quench surface or at an angle with respect thereto.

The molten metal is carried from the arc to the quench surface by compressed gas. The compressed gas carries the molten metal as a fine spray. The compressed gas is preferably at a pressure above about 35 pounds per square inch, with pressures of about 50 to 75 pounds per square inch being particularly preferred.

As herein contemplated, the two consumable wires 3, 5 are fed into the metallizer 1. Electrical current is transferred to the wires, e.g., through electrode tips, whereby to strike the arc 23. The arc 23 melts the wires 3, 5, forming a molten metal particles 25, which are propelled onto the electrode substrate 31 by the jet of compressed gas 21.

According to one exemplification, at least one electro arc wire, e.g., wire 3 or wire 5, contains iron and boron and at least one electrod arc wire, e.g., either wire 5 or wire 3 contains iron and the rare earth metal or metals.

Alternatively, a wire or filament of the alloy may be prepared and heated, e.g., by resistance heating or induction heating, to evaporate the alloy elements. The resulting vapor may be recovered as a film or as particles. The resulting product is a fine grain alloy.

The resulting product of this alternative method is a particulate fine grain alloy.

The fine grain particulate alloy material may be recovered by various methods, including electrostatic precipitation, particle extraction, settling, sedimentation, or the like.

In the second, or heat treating, stage of the process, the solid particles are heat treated to form a solid material having a morphology that provides a practical coercivity and the above described enhancement of remanence. The heat treated solid is comprised of grains meeting at grain boundaries. The grains and grain boundaries have the above described morphology associated with the enhanced remanence magnetic material.

In one exemplification the magnetic alloy material is an alloy of iron, optionally with other transition metals, as cobalt, a rare earth metal or metals, boron, and a modifier. In another exemplification the magnetic alloy material is an alloy of a ferromagnetic transition metal as iron or cobalt, with an lanthanide, as samarium, and a modifier.

A modifier is an alloying element or elements added to a magnetic material which serve to improve the isotropic magnetic properties of the resultant material, when compared with the unmodified material, by an appropriate processing technique. Exemplary modifiers are silicon, aluminum, and mixtures thereof. Alternative or additional modifiers may include lithium, hydrogen, fluorine, phosphorous, sulfur, germanium, and carbon. It is possible that the modifier acts as a grain refining agent, providing a suitable distribution of crystallite sizes and morphologies to enhance interactions.

The amount of modifier is at a level, in combination with the quench parameters, to give the above described isotropic magnetic parameters.

While the alloys referred to herein have modifiers, which are believed to control grain nucleation and growth, the crystallite size and size distribution may be obtained by proper choice and control of the solidification technique employed. For example, such solidification methods as gas atomization, metallization, chemical vapor deposition, and the like may be used as an alternative to rapid solidification from the melt, even without the modifier. The modifier acts during solidification from the liquid state, or during grain nucleation and growth from the amorphous state, e.g., as a grain refining agent or a nucleating agent, to provide the distribution of crystallite size and morphology necessary for enhanced properties.

When modifiers are indicated as being present, it is to be understood that other methods of providing nucleation sites and/or obtaining uniform grain size may be used.

The magnetic alloy may be of the type

[Rare Earth Metal(s)]-[Transition Metal(s)]-[Modifier(s)], for example

[Sm]-[Fe, Co]-[Si, Al].

Another interacting alloy may be of the type

[Rare Earth Metal(s)]-[Transition Metal(s)]-Boron-[modifier(s)], for example

[Rare Earth Metal(s)]-[Fe,Co]-Boron-[modifier(s)], and [Rare Earth Metal(s)]-[Fe,Co,Mn]-Boron-[modifier(s)].

In one exemplification, the magnetic alloy material has the stoichiometry represented by:

$(Fe,Co,Ni)_a(Nd,Pr)_bB_c(Al,Si)_d$, exemplified $Fe_a(Nd,Pr)_bB_c(Al, Si)_d$, where a, b, c, and d represent the atomic percentages of the components iron, rare earth metal or metals, boron, and silicon, respectively, in the alloy, as determined by energy dispersive spectroscopy (EDS) and wave length dispersive spectroscopy (WDS) in a scanning electron microscope;

$a+b+c+d=100$;

a is from 75 to 85;

b is from 10 to 20, and especially from 11 to 13.5;

c is from 5 to 10;

and d is an effective amount, when combined with the particular solidification or solidification and heat treatment technique to provide a distribution of crystallite size and morphology capable of interaction enhancement of magnetic parameters, e.g., from traces to 5.0.

The rare earth metal is a lanthanide chosen from neodymium and praseodymium, optionally with other lanthanides (one or more La, Ce, Sm, Eu, Gd, Tb, Dy, Ho, Er, Tm, Yb and Lu), Sc, Y, and mixtures thereof present. While various combinations of the rare earth metals may be used without departing from the concept of this invention, especially preferred rare earth metals are those that exhibit one or more of the following characteristics: (1) the number of f-shell electrons is neither 0 (as La), 7 (as Gd) or 14 (as Lu), (2) low molecular weight lanthanides, such as La, Ce, Pr, Nd, and Sm, (3) high magnetic moment lanthanides that couple ferromagnetically with iron, as Nd and Pr, or (4) relatively inexpensive lanthanides, as La, Ce, Pr, and Nd. Especially preferred are Nd and Pr. Various commercial and/or byproduct mischmetals may be used. Especially preferred mischmetals are those rich in Nd and/or Pr.

While the invention has been described with respect to certain preferred exemplifications and embodiments thereof, it is not intended to limit the scope of the invention thereby, but solely by the claims appended hereto.

We claim:

1. A method of forming an enhanced isotropic remanence magnetic material comprising a solid mass of grains of an alloy of the rare earth-transition metal - boron type having $P4_2/mnm$ tetragonal crystallography, which method comprises the steps of:

(a) vaporizing precursors of the magnetic material;

(b) condensing the precursors of the magnetic material whereby to form a condensate solid alloy having a fine grain morphology characterized by one or more of:

(i) amorphous, (ii) microcrystalline, and (iii) polycrystalline;

wherein the grains thereof have an average grain characteristic dimension less than that of the enhanced remanence magnetic material; and (c) heat treating the fine grain solid to form a magnetic material comprised of grains having a characteristic dimension, $R_o$, of about 200 Angstroms such that the grain-grain interaction between adjacent grains substantially equals the magnetic anisotropy field of the individual grains, and magnetically aligns grains away from their easy axis of magnetization, the grains meeting at grain boundaries having a characteristic dimension small enough to allow the grain-grain interaction between adjacent grains, so as to form an enhanced remanence magnetic material having an isotropic maximum magnetic energy product, $(BH)_{max}$, greater than 15 megaGaussOersteds and an isotropic remanence greater than 9 kiloGauss.

2. The method of claim 1 comprising forming a first alloy of precursors of the magnetic material, vaporizing the first alloy, and condensing the vapor.

3. The method of claim 2 comprising vaporizing the first alloy in a plasma.

4. The method of claim 3 comprising recovering the fine grain alloy from the plasma as particles.

5. The method of claim 1 wherein the anisotropy energy of the individual grains of the heat treated magnetic material is strong enough to result in a coercivity above about 8 kilooersteds.

6. The method of claim 1 wherein the alloy has the nominal composition $RE_2TM_{14}B_1$, where RE represents a rare earth metal or metals, and TM represents a transition metal or metals.

7. The method of claim 6 wherein the rare earth metal is chosen from the group consisting or praseodymium and neodymium.

8. The method of claim 6 wherein the transition metal is chosen from the group consisting of iron, cobalt, and nickel.

9. The method of claim 6 wherein the magnetic material further comprises one or more modifiers.

10. The method of claim 9 wherein the modifier is chosen from the group consisting of aluminum and silicon.

11. The method of claim 9 wherein the modifier is a grain refining agent.

12. The method of claim 11 wherein the grain refining agent modulates the competing rates of nucleation and grain growth to provide a solid, heat treated magnetic material with a characteristic grain dimension, $R_o$, of about 200 Angstroms, and a distribution about the characteristic dimension to substantially avoid the effects of low coercivity and multidomain grains.

13. The method of claim 1 wherein the tetragonal phase has the nominal composition:

$$Fe_a(Nd,Pr)_bB_c(Si,Al)_d$$

where $75<a<85$,
$10<b<20$,
$5<c<10$, and
$0<d<5$.

* * * * *